US006902141B2

(12) United States Patent
Kirby

(10) Patent No.: US 6,902,141 B2
(45) Date of Patent: Jun. 7, 2005

(54) ROLLER SHADE MOUNTING SYSTEM

(75) Inventor: David A. Kirby, Emmaus, PA (US)

(73) Assignee: Lutron Electronics Co., Ltd., Coopersburg, PA (US)

( * ) Notice: Subject to any disclaimer, the term of this patent is extended or adjusted under 35 U.S.C. 154(b) by 0 days.

(21) Appl. No.: 10/338,066

(22) Filed: Jan. 6, 2003

(65) Prior Publication Data

US 2004/0129850 A1 Jul. 8, 2004

(51) Int. Cl.[7] ..... E06B 9/17
(52) U.S. Cl. ..... 248/266; 160/323.1
(58) Field of Search ..... 248/266, 267, 248/268, 269, 252; 160/323.1, 903

(56) References Cited

U.S. PATENT DOCUMENTS 1,090,931 A * 3/1914 McLean ..... 160/313
1,688,563 A * 10/1928 Tomlinson ..... 160/301
1,882,592 A * 10/1932 Hendrickson ..... 160/326
3,179,160 A * 4/1965 Polsky ..... 160/298
3,853,170 A * 12/1974 Barettella ..... 160/323.1
4,729,418 A * 3/1988 Rude ..... 160/323.1
5,505,418 A * 4/1996 Corcoran ..... 248/254
5,881,792 A * 3/1999 Cheng ..... 160/263

* cited by examiner

*Primary Examiner*—Leslie A. Braun
*Assistant Examiner*—Kofi Schulterbrandt
(74) *Attorney, Agent, or Firm*—Drinker Biddle & Reath LLP

(57) ABSTRACT

A roller shade mounting system includes a pair of assemblies for limiting sagging in a roller shade tube. The assembly includes a single bearing supported by a shaft to position the bearing at a distance from an end of the tube. Alternatively, the assembly includes a bearing pair supported by a shaft to define spaced support points for applying a reaction moment the roller tube. The assembly further includes an attachment member secured to the shaft at a first end and to the structure at an opposite second end, either directly, or to a mounting bracket secured to the structure. The mounting assembly may further include a deflection adjustment member engaging the attachment member and a fixed support member to provide variable control of roller tube deflection.

14 Claims, 13 Drawing Sheets

ROLLER SHADE MOUNTING SYSTEM

FIELD OF THE INVENTION

The present invention relates generally to roller shades, and more particularly to a mounting system for supporting roller shades having long roller tubes.

BACKGROUND OF THE INVENTION

Roller shade systems having flexible shades supported by elongated roller tubes are well known. The roller tube, typically made from aluminum or steel, is rotatably supported to provide for winding receipt of the flexible shade on the roller tube. Roller shades include manual shades having spring driven roller tubes and motorized shades having drive motors engaging the roller tube to rotatingly drive the tube. The drive motors for motorized shades include externally mounted motors engaging an end of the roller tube and internal motors that are received within an interior defined by the tube.

Conventional roller shades have support systems that engage the opposite ends of the roller tube to provide the rotatable support that is required for winding and unwinding of the flexible shade. Referring to FIG. 1, for example, there is shown an end portion of a roller tube 2 that is rotatably supported in a conventional manner. The support system, shown schematically in FIG. 1, includes a drive end support assembly having a coupler 3 engaging the open end 4 of the tube 2 for rotation therewith. The coupler 3 is adapted to receive the drive shaft 6 of motor 5 such that rotation of the drive shaft is transferred to the coupler for rotation of the tube 2. As shown, the motor 5 is secured to a bracket 7 for attachment of the roller shade to the wall or ceiling of a structure, for example. A coupler engaging an opposite end of the roller tube (not seen) could receive a motor drive shaft or, alternatively, could receive a rotatably supported shaft of an idler assembly. An example of a roller shade including an end supported tube is shown in U.S. patent application Ser. No. 10/039,818.

A roller shade tube supported in a conventional manner from the opposite ends will deflect in response to transverse loading, from the weight of an attached shade for example, substantially similar to a beam structure having support conditions known as "simple supports". A simply supported beam is vertically supported but is not restrained against rotation at the support locations. The response of a roller tube, supported at its ends in a conventional manner, to transverse loading is illustrated in FIG. 2. The distance, L, between the support points for the roller tube 8, also known as effective length, is substantially equal to the overall length of the tube. Transverse loading applied to the end-supported roller tube 8, from the weight, W, of a flexible shade 9 as well as from self-weight of the tube, results in a downward "sagging" deflection, d, in a central portion of the roller tube 8 with respect to the supported ends.

For roller shades having wider shades (e.g., widths of 15 to 30 feet or more), support of the correspondingly long roller tubes in a conventional manner can result in sagging deflection detrimental to the appearance of a supported shade. As illustrated in FIG. 2, V-shaped wrinkles, also known as "smiles", can be formed in an unrolled shade supported by a sagging roller tube. Sagging deflection in a conventionally supported roller tube can also have a detrimental effect on shade operation. During winding of a shade, the shade is drawn onto the tube in a direction that is substantially perpendicular to the axis of the tube. Due to curvature along the length of a sagging tube, opposite end portions of a supported shade will tend to track towards the center portion of the tube as the shade is rolled onto the tube. Such uneven tracking of opposite end portions of the shade can cause the end portions to be wound more tightly onto the end portions of the roller tube than the central portion of the roller tube. As a result, the central portion of the shade is not pulled tightly to the tube causing it to tend to buckle. This buckling of the central portion of the shade, if severe enough, can create variations in radial dimensions of the rolled shade along the length of the tube, thereby impairing subsequent rolling of lower portions of the shade.

Transverse deflection in a simply supported beam will vary depending on the effective length of the beam, the shape and dimensions of the beam cross section and the properties of the material from which the beam is made. For a simply supported beam having a point load, P, applied at the center, the transverse deflection at the beam center will be equal to $PL^3/48EI$, where E is the elastic modulus for the material and I is the modulus of inertia. The modulus of inertia, I, is a function of section geometry and is based on the second moment of area for the beam cross section taken about the centroidal axis. Since deflection increases exponentially (as the cube) with increasing tube length, it is understandable that excessive sagging deflection results when relatively long roller tubes are end-supported in a conventional manner.

The problem of sagging deflection in longer roller tubes has been addressed in prior art roller shades by increasing the diameter of the roller tube. Increase in tube diameter results in a shift of material to a greater distance from the tube centroidal axis such that the modulus of inertia, I, is increased. As shown by the above-discussed equation, sagging deflection in an end supported roller will decrease in direct proportion to increase in the moment of inertia, I. A known roller shade system with shades having a width of 20 feet, for example, includes a correspondingly long roller tube having a diameter of approximately 4¾ inches. Increasing the shade width to 25 feet required that the tube diameter be increased to 6¼ inches to prevent excessive sagging deflection in the roller tube. Increasing the shade width beyond 25 feet required that the roller tube diameter be increased to 8 inches or more.

Although increase of the roller tube diameter serves to reduce sagging deflection in conventional end-supported tubes, there are undesirable consequences associated with such a solution. Increasing the diameter of the roller tube increases weight, thereby potentially affecting the size and type of structure capable of providing rotatable support for the tube. Also, additional space required by the larger diameter roller tube and its associated support structure may not be readily available in many installations.

SUMMARY OF THE INVENTION

The present invention provides a mounting system including a pair of assemblies for mounting a shade roller having a roller tube. According to a first embodiment, each assembly includes a bearing that is receivable within an interior defined by the roller tube and adapted for engagement therewith to define a support point for rotatably supporting the tube. The support points of the assemblies define an unsupported central tube portion therebetween. Each assembly further includes a bearing support member having opposite first and second ends, the bearing being connected to the support member adjacent the first end. The bearing support member is receivable within the tube interior to position the bearing at a sufficient distance from one of opposite ends of the tube to reduce the length of the unsupported central tube portion such that sagging deflection of the roller tube is limited.

Each assembly preferably includes an attachment member having first and second ends. The first end of the attachment member is connected to the bearing support member such that the bearing support member extends adjacent at least a portion of the attachment member. The second end of the attachment member is adapted for operably connecting the attachment member to the structure. The attachment member includes an end plate at the first end of the attachment member secured to an end of the bearing support member. The attachment member further includes a top wall secured to the end plate and side walls secured to opposite sides of the top wall. The top and side walls of the attachment member extend substantially parallel to the bearing support member.

According to a second embodiment, each assembly includes first and second bearings that are receivable within an interior defined by the roller shade tube and adapted to engage the tube for rotatably supporting the tube. The assembly further includes an elongated bearing support member supporting the first and second bearings for engagement with the roller shade tube at spaced locations in an end portion of the tube. The assembly preferably includes an elongated attachment member having opposite first and second ends. The attachment member is connected to the bearing support member at the first end and is adapted at the second end for connecting the attachment member to a structure.

The assembly preferably also includes a deflection adjustment mechanism including a separating member operably engaging the attachment member and a fixed support member to establish a set deflection of the attachment member. The deflection of the attachment member causes the first and second bearings to apply a reaction moment to one of the end portions of the roller shade tube. The separating member is adjustable to provide for variation of the set deflection and the corresponding reaction moment.

DETAILED DESCRIPTION OF THE PREFERRED EMBODIMENTS

The present invention provides a system for mounting a roller shade to a structure with limited or controlled deflection resulting in the roller shade tube. Limitation or control of roller tube deflection is particularly desirable in roller shades having wide shades and correspondingly long roller tubes, which are susceptible to sagging deflections. As used herein, the term "sagging deflection" refers to deflection of a central portion of the roller tube relative to the opposite ends. Sagging deflection, therefore, could involve deflections at the tube ends as well as in the central portion, depending on the support conditions for the roller tube. As will be described in greater detail, the mounting systems according to the present invention limit or control sagging deflection in the central portion of a roller shade tube. In contrast to prior roller shade systems, the present invention addresses sagging deflection by modifying the support conditions for the shade roller tube instead of by increasing tube diameter.

Figure 1:
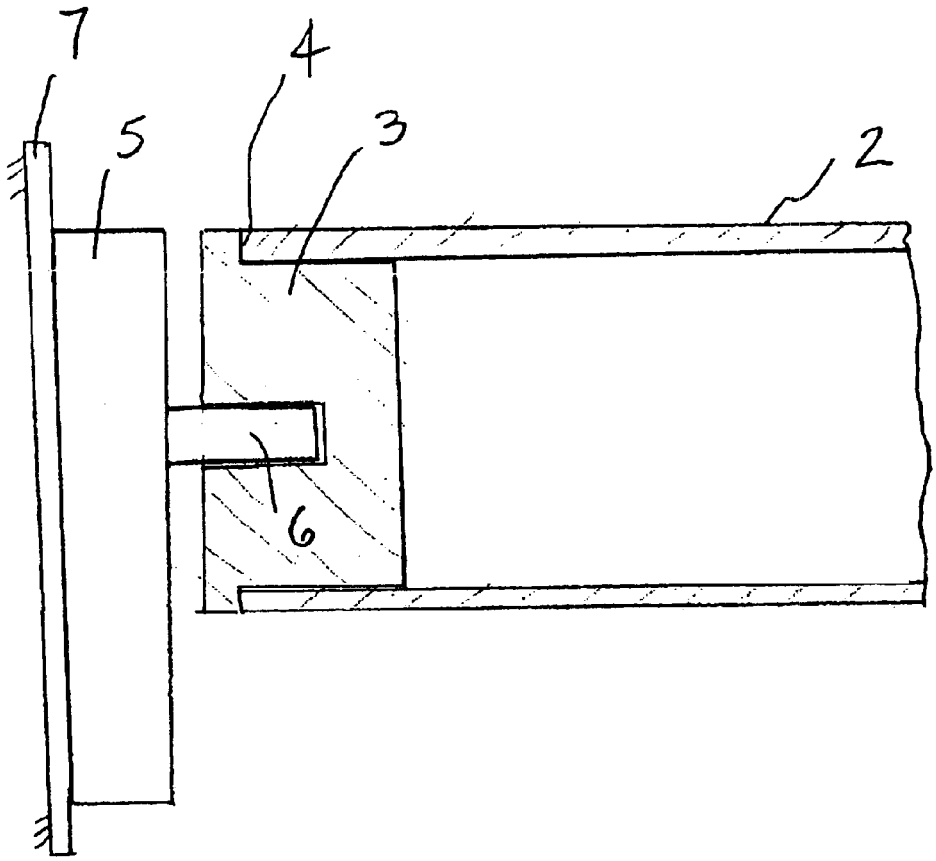
FIG. 1 (Prior Art)
FIG. 1 is a partial side elevational view, partly in section, schematically illustrating support of a roller shade tube at an end in a conventional manner.
Figure 2:
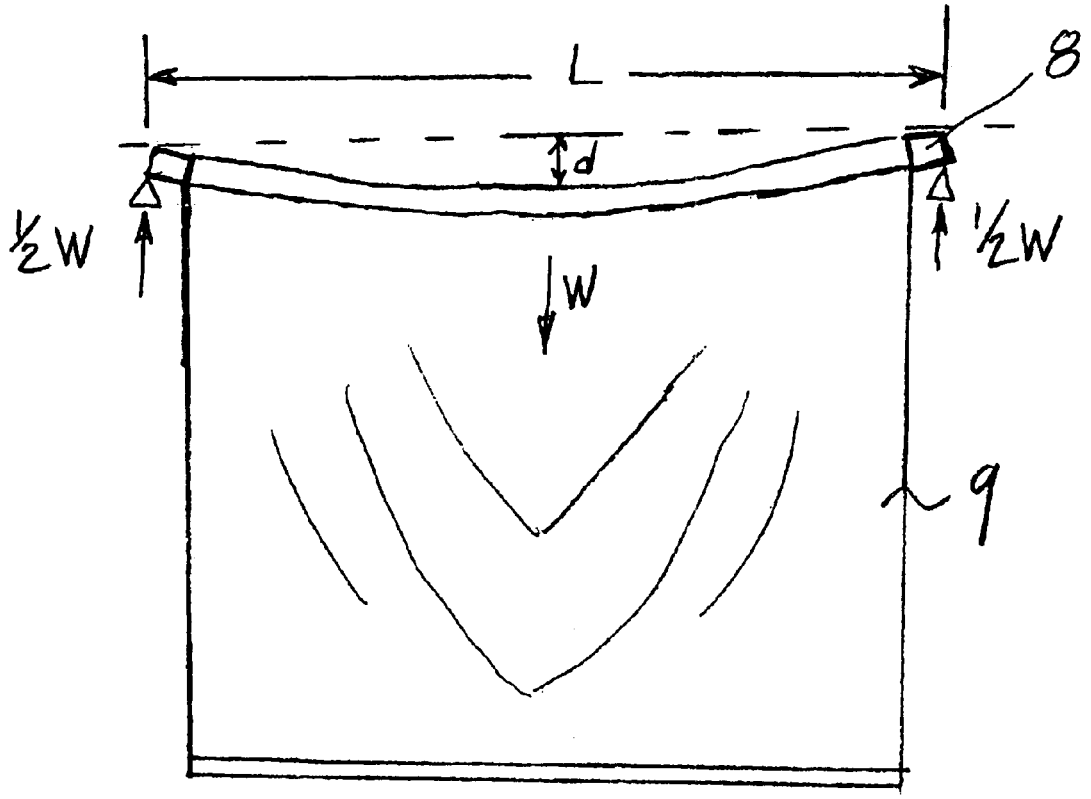
FIG. 2 (Prior Art)
FIG. 2 is a side elevational view of a shade roller having a roller tube supported in a conventional manner at opposite ends.
Figure 3:
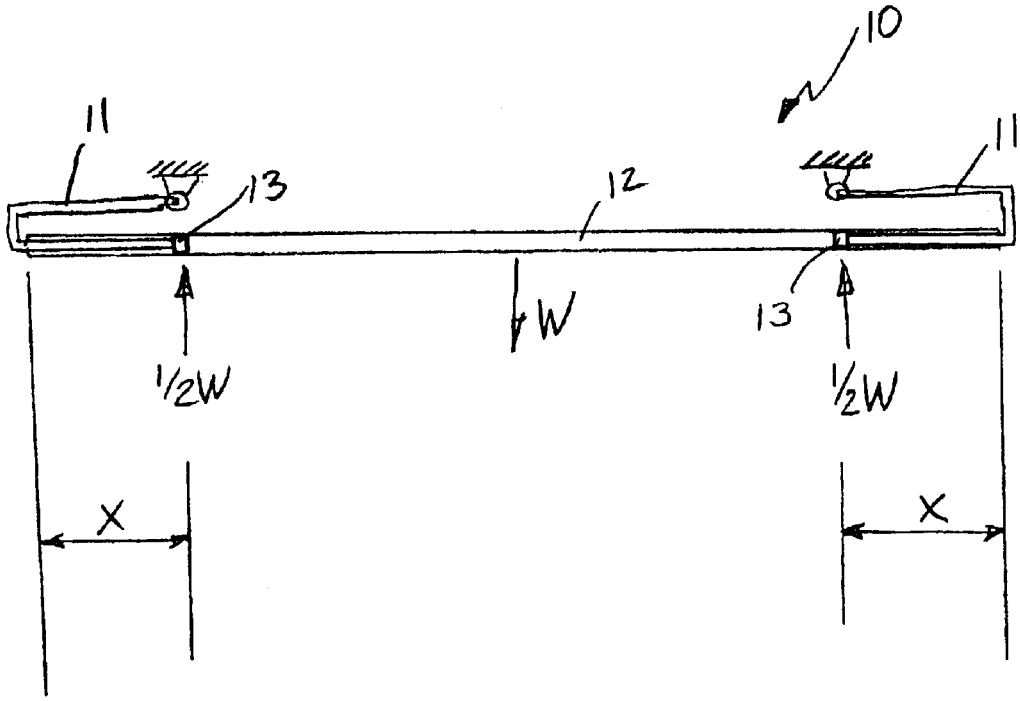
FIG. 3 is a schematic side elevational view illustrating a shade roller having a roller tube supported by a mounting system according to a first embodiment of the invention.

Referring to FIG. 3, a shade roller mounting system 10 according to a first embodiment of the present invention is illustrated schematically. The mounting system 10 includes first and second assemblies 11 each adapted to engage one of opposite end portions of a shade roller tube 12. The assembly 11 includes a bearing 13 that is adapted to engage the roller tube 12 for rotatable support of the tube. As shown, a portion of the assembly 11 is receivable within an interior defined by the roller tube 12 to position the bearing at a distance, x, from one of the ends of the tube. The assembly 11 is further adapted for connection to a ceiling of a structure, as illustrated, for securing the roller shade to the structure. The assembly 11 could, alternatively, be secured to a wall of the structure.

The distance x, which represents the distance by which the support points for roller tube 12 have been inwardly shifted, represents a significant portion of the overall length of the roller tube. In the system shown in FIG. 3, the distance x equals approximately ⅕ of the overall length of the tube 12. The invention, however, is not limited to any particular ratio between the distance x and the overall tube length. The inward shift of the support locations provided by the mounting system 10 is sufficient to limit sagging deflection in the central portion of the tube 12 in comparison to a similar roller tube supported in a conventional manner at the ends of the tube.

Figure 4A:
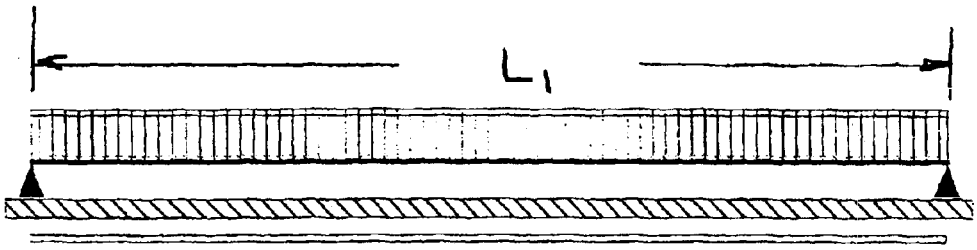
FIGS. 4A–4D are side elevational views comparing boundary support conditions and deflection profiles for a simply supported beam having end supports and a simply supported beam having inwardly shifted supports according to the mounting system of FIG. 3.
Figure 4B:
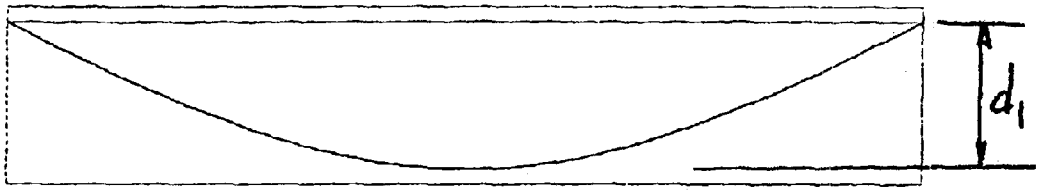

Referring to FIGS. 4A–4D, the manner in which the support conditions for a roller shade tube are modified by mounting system 10, and the resulting effect on sagging deflection, is illustrated. Referring first to FIG. 4A, there is shown a beam structure simply supported at opposite ends and having an overall length, $L_1$. As discussed previously, a roller tube supported in a conventional manner at the opposite ends will deflect in a substantially equivalent manner as the simply supported beam shown in FIG. 4A. Under an evenly distributed loading as shown, such as would be applied to a roller tube from the weight of a supported shade, the equivalent beam structure will have a deflected profile shown in FIG. 4B and a sagging deflection $d_1$.

Figure 4C:
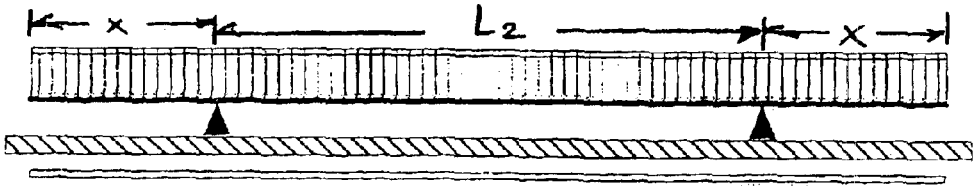

Referring to FIG. 4C, the beam structure shown in FIG. 4A modified to incorporate support conditions according to the mounting system 10 is shown. Accordingly, each of the supports has been inwardly shifted from one of the ends by a distance, x. As a result, the effective length of the unsupported central portion of the beam has been reduced to $L_2$. Deflection in the central portion of the beam, which varies in proportion to the cube of effective length as discussed above, is thereby reduced in comparison to the deflection of the end-supported beam shown in FIG. 4B. Because of the inward shift of the support points, the opposite end portions of the beam of FIG. 4C extend outwardly and unsupportedly from the support points. Extending in this outward manner from the support points, the end portions function like cantilevers in counterbalancing relation to the central portion between the supports further reducing the sagging deflection.

Figure 4D:
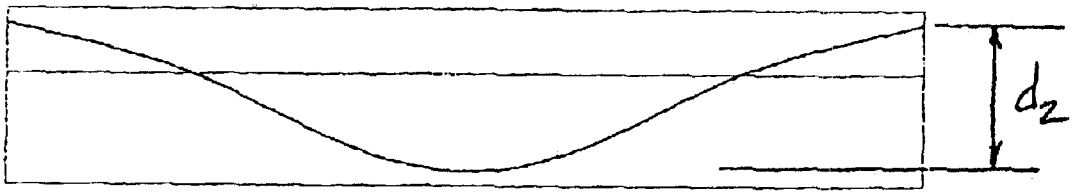

The beam of FIG. 4C having modified support conditions according to mounting system 10, will have a deflected profile and sagging deflection, $d_2$, as shown in FIG. 4D. With respect to the support location, the beam deflects downwardly in a central portion and upwardly in the opposite end portions. The deflections, however, will be additive for the sagging deflection $d_2$, which as discussed above, represents the relative deflection between the center and the opposite ends. As an example, a shade roller including a 30 foot long tube and having a diameter of 5.5 inches was supported in the conventional manner at the opposite ends of the tube. The sagging deflection, d1, for the shade roller tube was equal to approximately 0.7 inches. The same shade roller was then supported by mounting system 10 such that each of the supports was inwardly shifted by a distance x equal to 5 feet. As a result, sagging deflection was reduced by more than 90 percent to approximately 0.06 inches.

Figure 6:
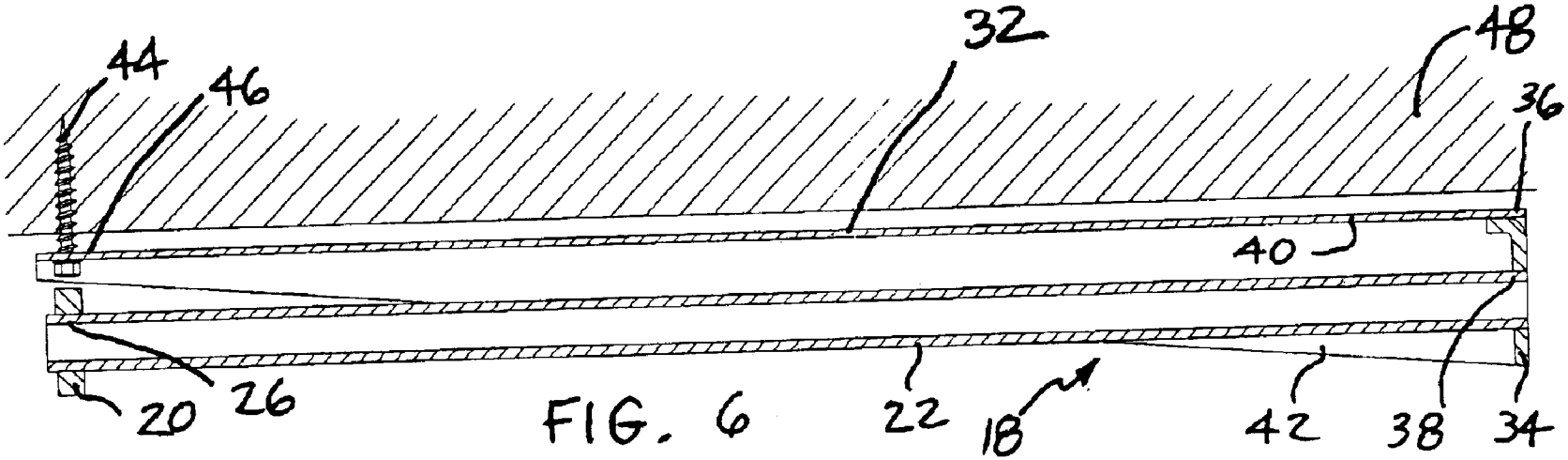
FIG. 6 is a sectional view taken along the lines 6—6 in FIG. 5A.
Figure 5:
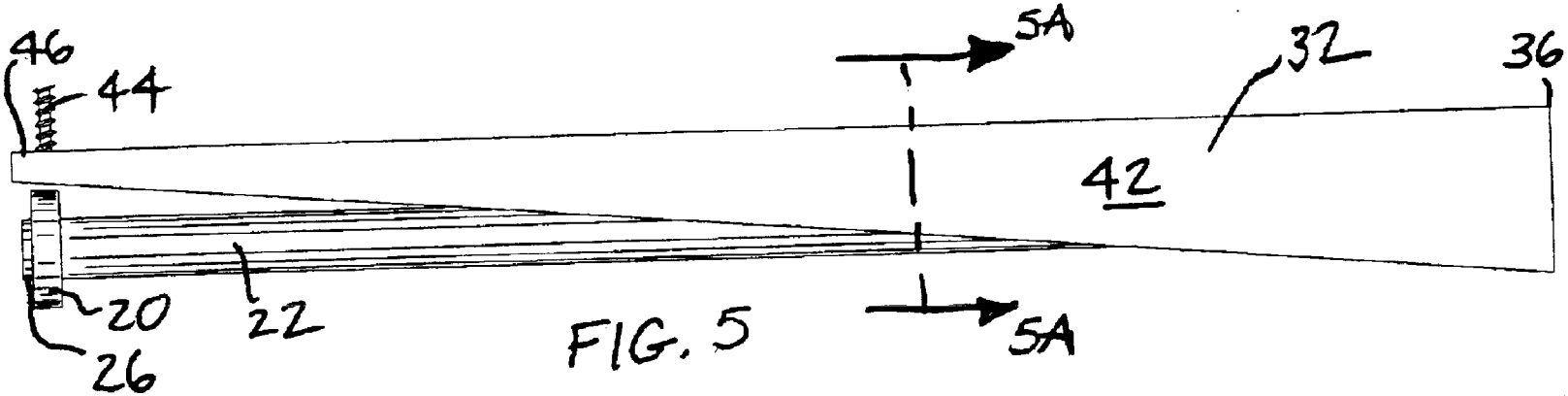
FIG. 5 is a side elevational view of a preferred mounting assembly according to the mounting system shown in FIG. 3.
Figure 5A:
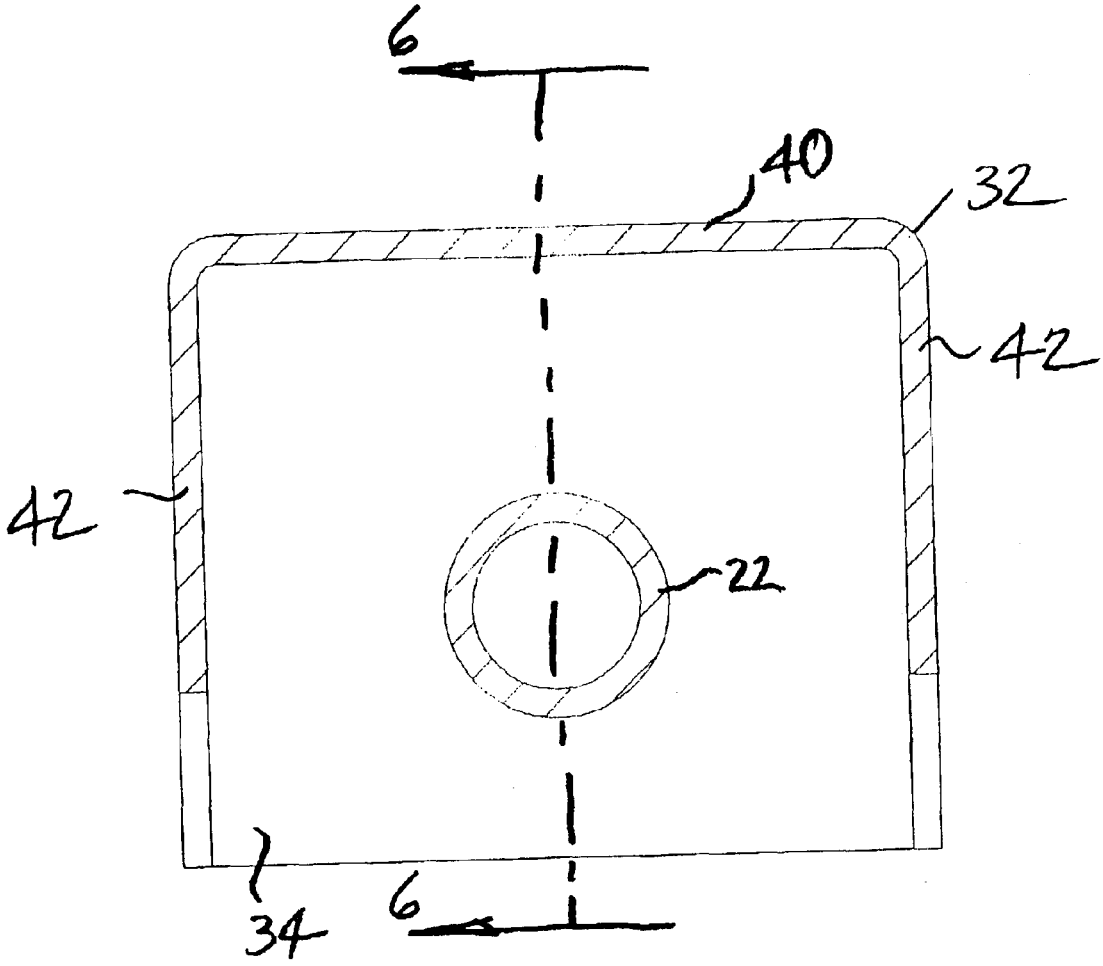
FIG. 5A is a sectional view taken along the lines 5A—5A in FIG. 5.
Figure 7:
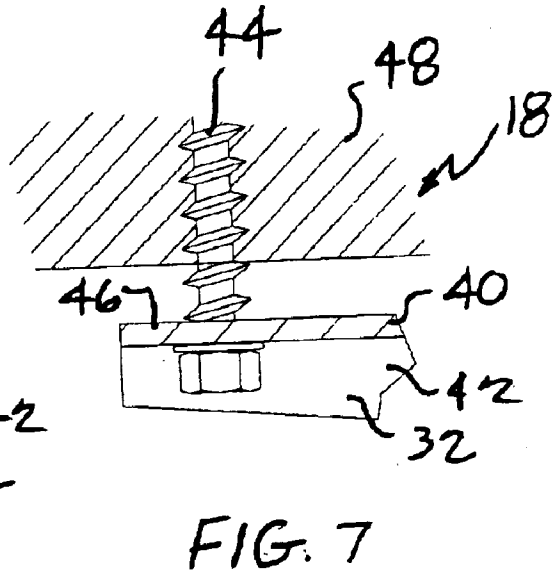
FIGS. 7–9 are detail views showing alternative means of connecting the mounting assembly of FIGS. 5–6 to the ceiling of a structure.

Referring to FIGS. 5–7, a preferred mounting assembly 18 constructed in accordance with the mounting system 10 of FIG. 3 is shown. The mounting assembly 18, one of a pair of assemblies engageable with opposite end portions of a roller tube, includes a bearing 20 supported adjacent a first end of an elongated bearing support shaft 22. The mounting assembly 18 further includes an attachment member 32 for connecting the bearing support shaft 22 to a fixed support member of a structure, such as a wall or ceiling of a facility for example. The attachment member 32 includes an end plate 34 at a first end 36 of the attachment member 32. The end plate 34 of the attachment member 32 is secured to a second end 38 of the bearing support shaft 22, preferably by welding. The attachment member 32 further includes a top wall 40 and a pair of side walls 42 that are located on opposite sides of the bearing support shaft 22. As shown in the sectional view of FIG. 5A, the top wall 40 and side walls 42 form a U-shaped portion that is secured to the end plate 34 to extend adjacent the elongated bearing support shaft 22 substantially parallel thereto. Screws 44 are received by the top wall 40 of the attachment member 32 adjacent a second end 46 to secure the attachment member to a ceiling 48 of a structure.

Each of the side walls 42 of the attachment member 32 tapers between the first end 36 of the attachment member 32 and the second end 46 such that the height of the side walls 42 is minimum at the second end 46. The tapering of the side walls 42 in this manner reduces the weight of the assembly 18. The tapering of the side walls 42 also provides access to the top wall 40 at the second end 46 to facilitate placement of the screws 44 for securing the attachment member 32 to the ceiling 48. The attachment member 32 and the bearing support shaft 22 are substantially equal in length. This construction provides for positioning the bearing 20, as shown in FIGS. 3 and 6, adjacent the connection between the attachment member 32 and the ceiling 48.

Figure 8:
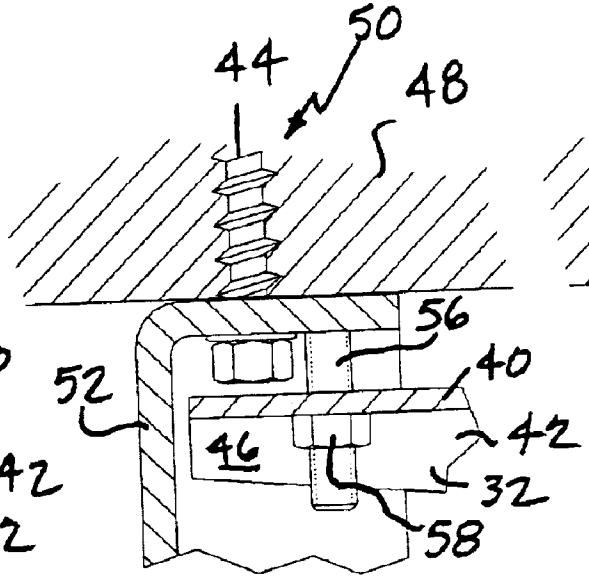
Figure 9:
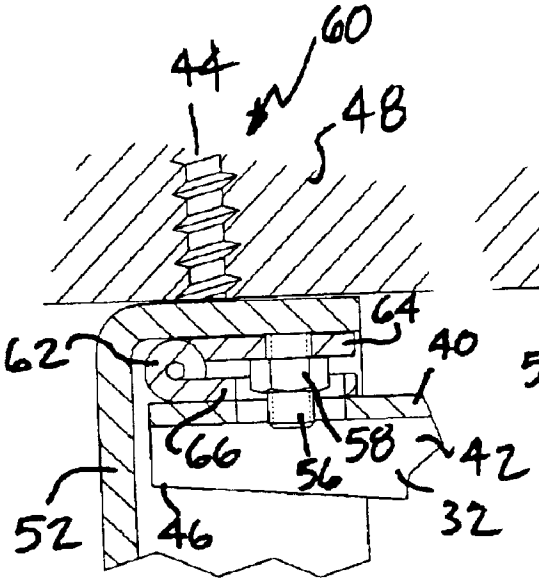

Referring to FIGS. 8 and 9, alternative means of connecting the attachment member 32 to the ceiling 48 of a structure are shown. In FIG. 8, a mounting assembly 50 includes a mounting bracket 52 for connecting attachment member 32 to a structure. The mounting bracket 52 is adapted to receive threaded fasteners 54 for mounting the bracket 52 to ceiling 48. Threaded shafts 56 extend downwardly from the bracket 52 and are received by the attachment member 32 adjacent the second end 46. Threaded nuts 58 engage the shafts 56 to provide for support of the attachment member 32 by the bracket 52. Referring to FIG. 9, shade roller mounting assembly 60 includes a hinge member 62 having first and second portions 64, 66 pivotably connected to each other. The first and second portions 64, 66 of the hinge member 62 are respectively secured to the mounting bracket 52 and to the attachment member 32 to facilitate pivoting between the attachment member 32 and the structure.

Figure 10:
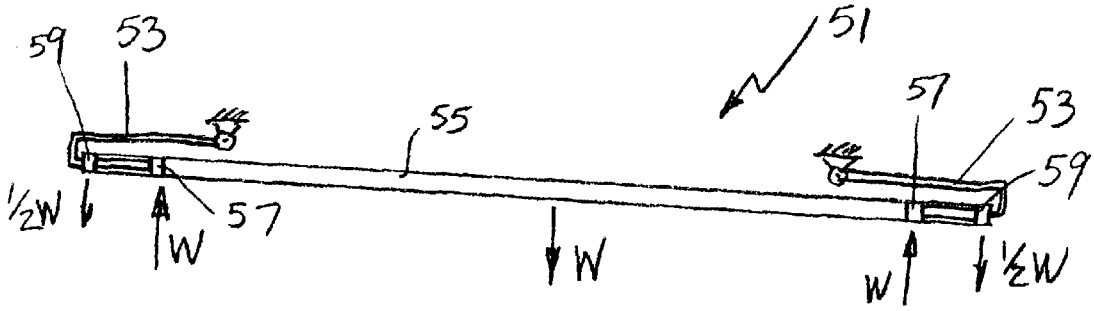
FIG. 10 is a schematic side elevational view illustrating a shade roller having a roller tube supported by a mounting system according to a second embodiment of the invention.
Figure 11:
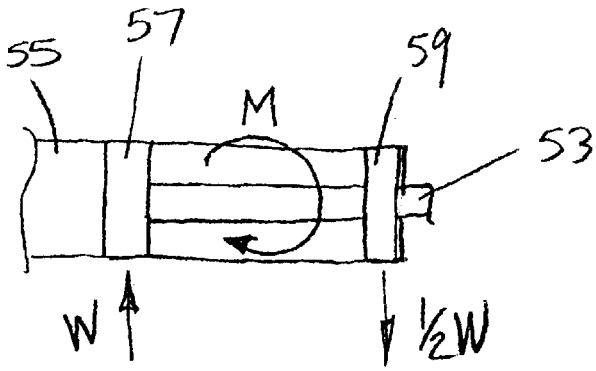
FIG. 11 is an enlarged detail view of a portion of the right hand side assembly of FIG. 10.

Each of the above-identified assemblies constructed according to shade mounting system 10 included a single bearing 20 engaging the roller tube. Referring to FIGS. 10 and 11, there is illustrated a shade mounting system 51 according to a second embodiment of the invention. The shade mounting system 51 includes mounting assemblies 53 engaging opposite end portions of a roller tube 55. The assembly 53 includes first and second bearings 57, 59 each adapted to engage the roller tube 55 for rotatably supporting the tube. Similar to the mounting assemblies of mounting system 10, a portion of the assembly 53 supporting the bearings 57, 59 is receivable within an interior defined by the roller tube 55. In contrast to mounting system 10, however, in which a single bearing defines an inwardly shifted support point, the engagement between the pair of bearings 57, 59 and the roller tube 55 results in oppositely directed reaction forces of W and 1/2W at the location of bearings 57, 59 respectively.

Referring to FIG. 11 showing the right hand side assembly 53 of FIG. 10, the oppositely directed reaction forces create a force couple that results in application of a clockwise moment, $M_R$, to the tube end portion. In a similar fashion, the bearings of the left hand side assembly 53 create a force couple applying a counterclockwise moment. Rotation of the opposite end portions of roller tube 53 in response to application of the moments to the opposite the moments $M_R$ drives the center portion of the roller tube 55 upwardly thereby reducing or eliminating sagging deflection.

Figure 12:
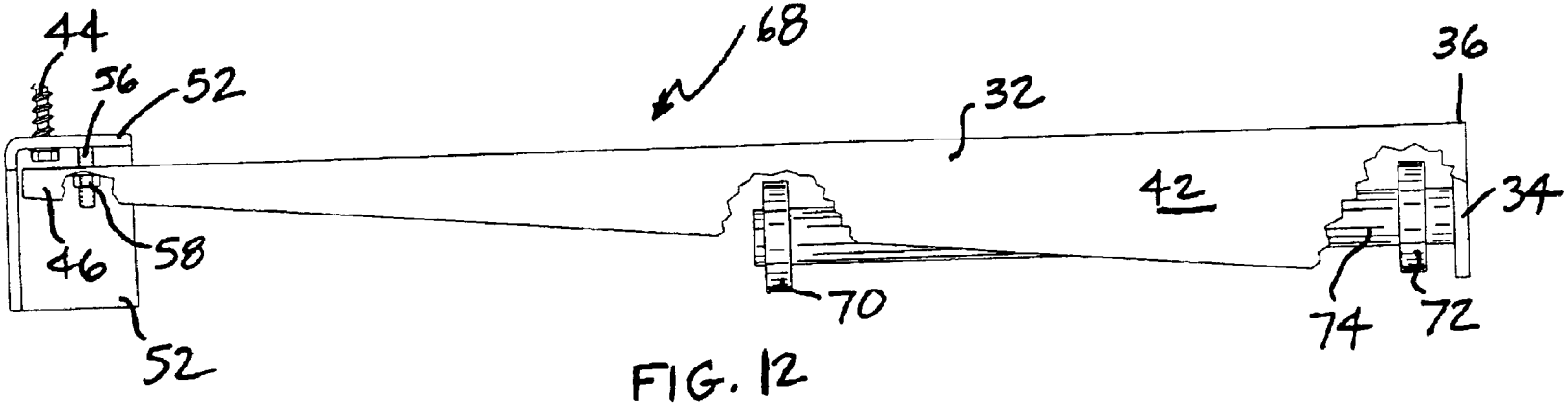
FIG. 12 is a side elevational view of a preferred mounting assembly according to the mounting system shown in FIG. 10.
Figure 13:
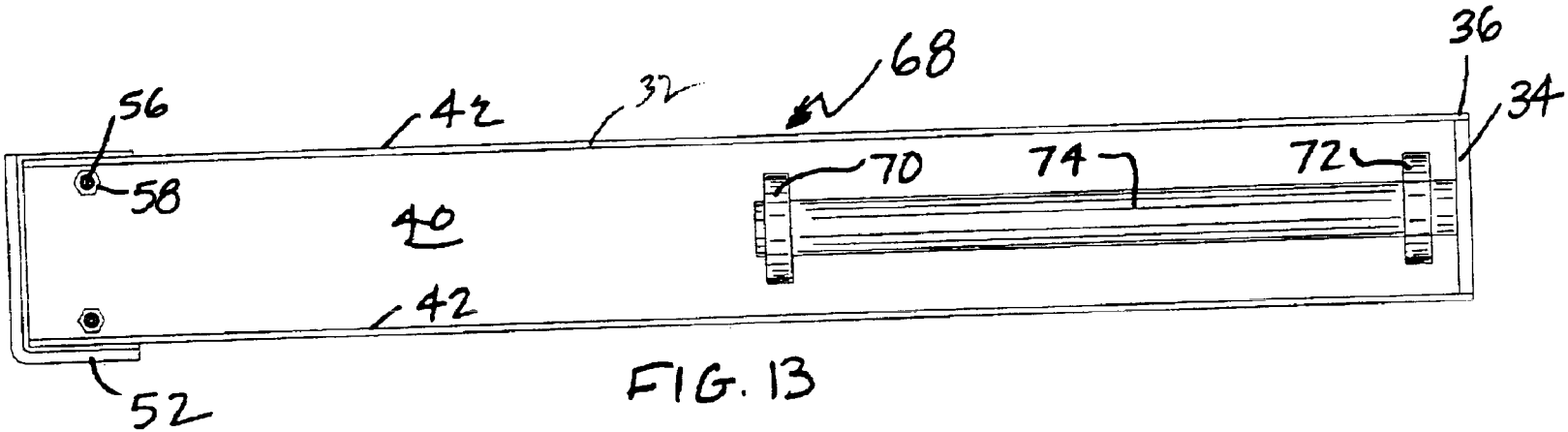
FIG. 13 is a bottom view of the mounting assembly shown in FIG. 12.

Referring to FIGS. 12 and 13, a preferred mounting assembly 68 in accordance with the mounting system 51 of FIGS. 10 and 11 is shown. The mounting assembly 68 includes first and second bearings 70, 72 rotatably supported by a bearing support shaft 74. The bearings 70, 72 are located adjacent opposite ends of the shaft 74 to position the first bearing 70 inwardly from an end of a roller tube and the second bearing 72 adjacent the end of the roller tube, as seen in FIG. 10. The bearing support shaft 74 is secured to an attachment member 32 that is, in turn, secured to a mounting bracket 52 in a similar fashion to the attachment member 32 of assembly 50 of mounting system 10 for connection between the attachment member and a structure.

Figure 14:
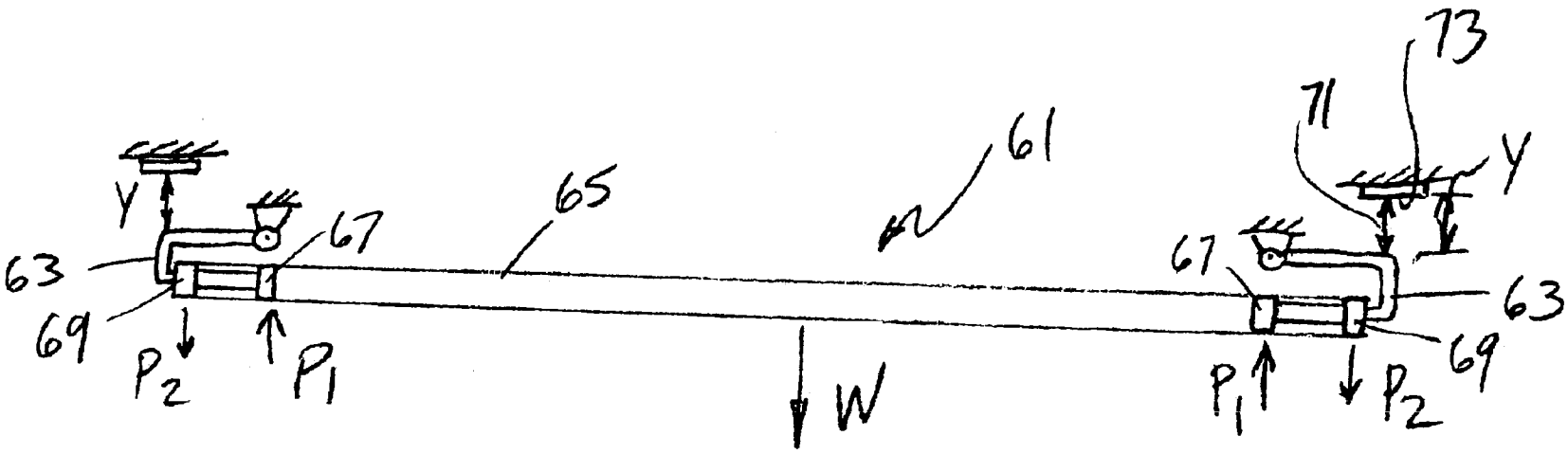
FIG. 14 is a schematic side elevational view illustrating a shade roller having a roller tube supported by a mounting system according to a third embodiment of the invention.

Referring to FIG. 14 a mounting system 61 according to a third embodiment of the invention is shown. The mounting system 61 includes mounting assemblies 63 engaging opposite end portions of a roller tube 65. Similar to the assembly 53 of mounting system 51, the assembly 63 includes first and second bearings 67, 69 each adapted to engage the roller tube 65 for rotatably supporting the tube. Also similarly to assembly 53, the portion of assembly 63 that supports the bearings 67, 69 is receivable within an interior defined by the roller tube 65.

In mounting system 51, the magnitude of the moments $M_R$ applied to the end portions of the tube 55 is determined by the weight W that is applied to the roller tube. In contrast, mounting system 61 includes adjustment mechanisms 71 that provide for variable control of the force couple that is applied to the roller tube by the bearings 67, 69. The adjustment mechanism 71 engages the assembly 63 and a fixed bearing surface 73 to maintain a set separating distance, y, between the assembly 63 and the fixed bearing surface 73. The deflection of the assembly 63 established by the adjustment mechanism 71 pivots the assembly 63 with respect to the structure to which the assembly is connected. The pivoting of assembly 63 causes a corresponding pivoting of the bearings 67, 69, supported by the assembly, which determines the magnitude of forces $P_1$ and $P_2$ of the force couple and the resulting magnitude of the moment that is applied at the roller tube end portion. Variation in the separating distance y by adjusting mechanism 71 results in variation in the deflection of assembly 63 and a corresponding change in the moments applied to the roller tube.

Figure 15:
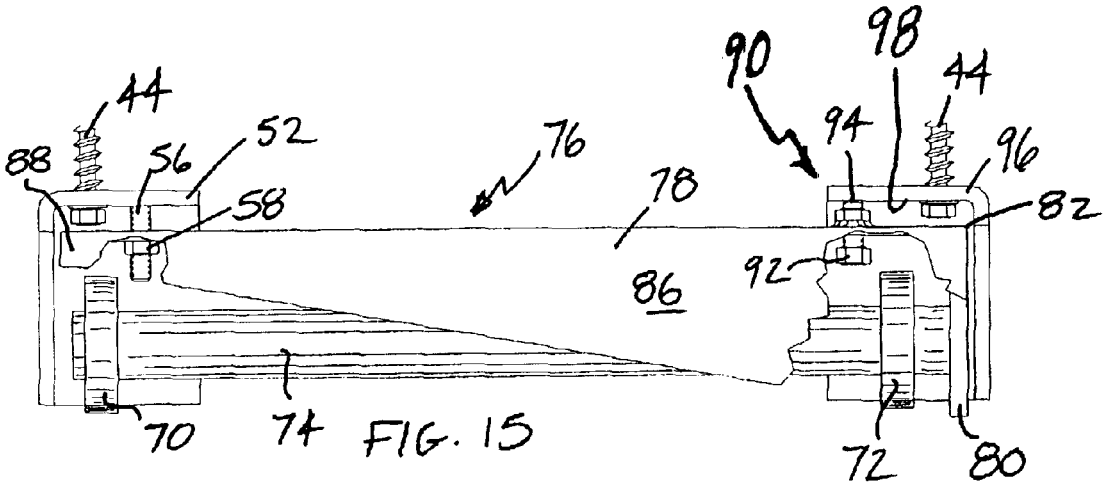
FIG. 15 is a side elevational view of a preferred mounting assembly according to the mounting system shown in FIG. 14.
Figure 16:
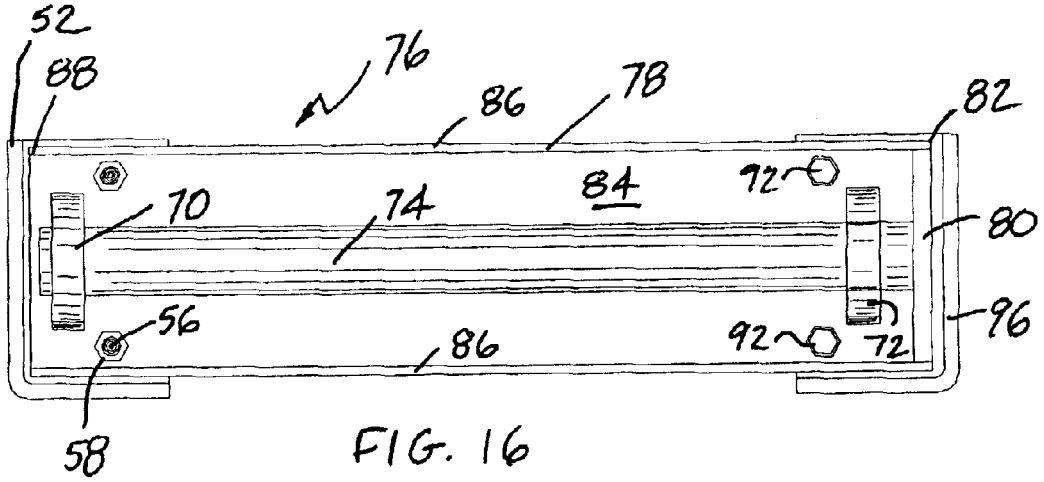
FIG. 16 is a bottom view of the mounting assembly shown in FIG. 15.

Referring to FIGS. 15 and 16, a preferred mounting assembly 76 according to mounting system 61 is shown. The mounting assembly 76 includes first and second bearings 70, 72 that are rotatably supported by a bearing support shaft 74. The bearing support shaft 74 is secured to an end plate 80 of an attachment member 78 located at a first end 82 of the attachment member 78. The attachment member 78 includes a top wall 84 and opposite side walls 86 extending between the first end 82 and an opposite second end 88 substantially parallel to the bearing support shaft 74. The bearing support shaft 74 and attachment member 78 are substantially equal in length. The attachment member 78 is secured to a mounting bracket 52 for connection of the assembly to the ceiling of a structure adjacent the first bearing 70.

An adjustment mechanism 90 includes a threaded adjustment member 92 engaging the attachment member 78 adjacent the first end 82 such that a terminal end 94 of the adjustment member 92 extends to a distance from the attachment member 78. A bracket 96 securable to the ceiling of a structure defines a fixed bearing surface 98 adapted for contact by the terminal end 94 of the threaded adjustment member 92 such that a set separation is maintained between the first end 82 of the attachment member 78 and the fixed bearing surface 98. As described above, the deflection of the first end 82 of the attachment member 78 determines the magnitude of forces $P_1$ and $P_2$ of the force couple and the resulting moment applied to the roller tube end. Threaded engagement between the threaded adjustment member 92 and the attachment member 78 provides for variation in the distance that the terminal end 94 extends from the adjustment member 78 and a corresponding variation in the set separation between the attachment member 78 and the fixed bearing surface 98. Such variation in the separation that is provided by the threaded engagement of the adjustment member 92 provides for adjustment of the moment applied at the end of the roller tube.

Figure 17:
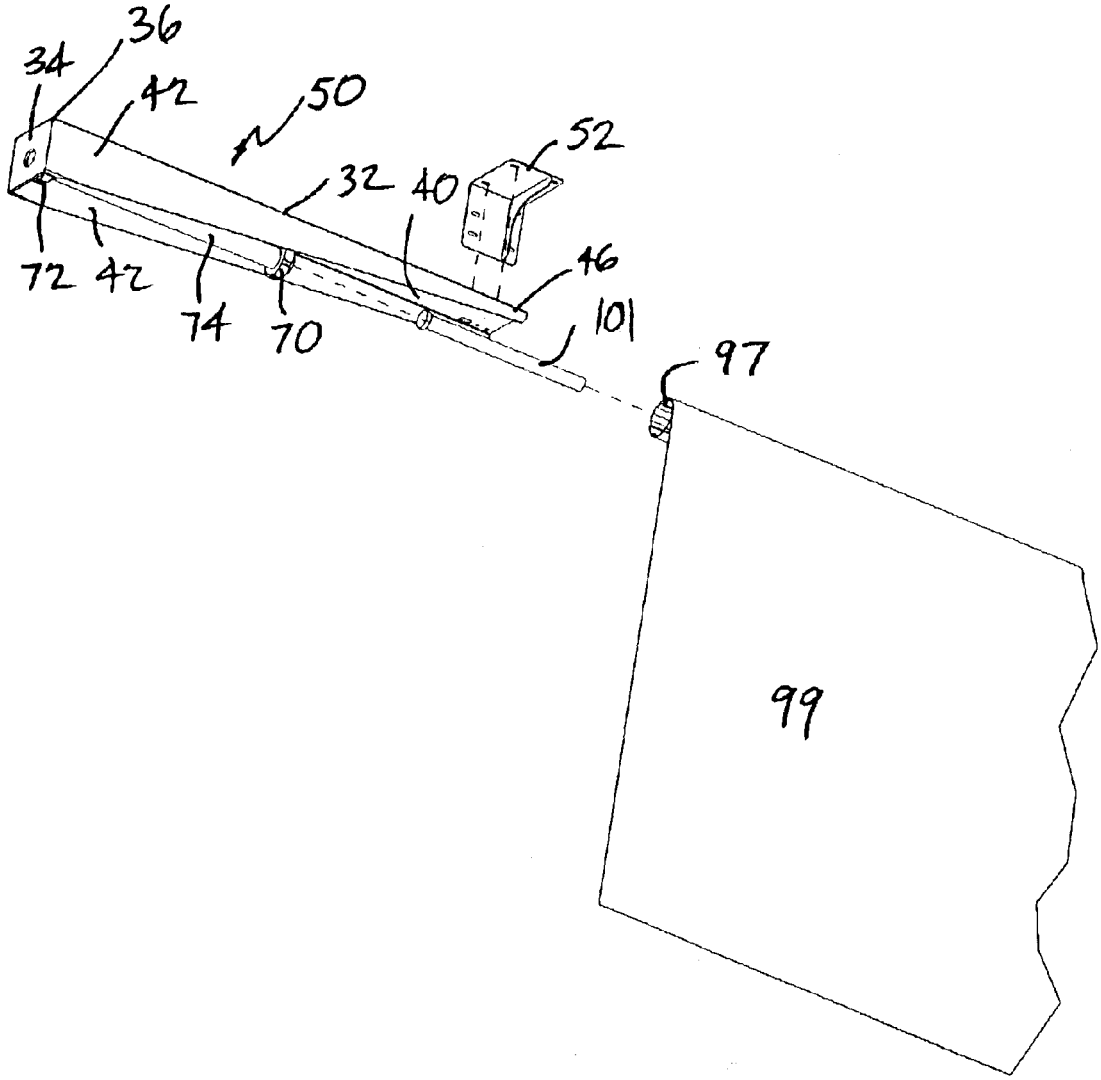
FIG. 17 is an exploded perspective view of a motorized shade roller incorporating a mounting system according to the present invention.
Figure 17A:
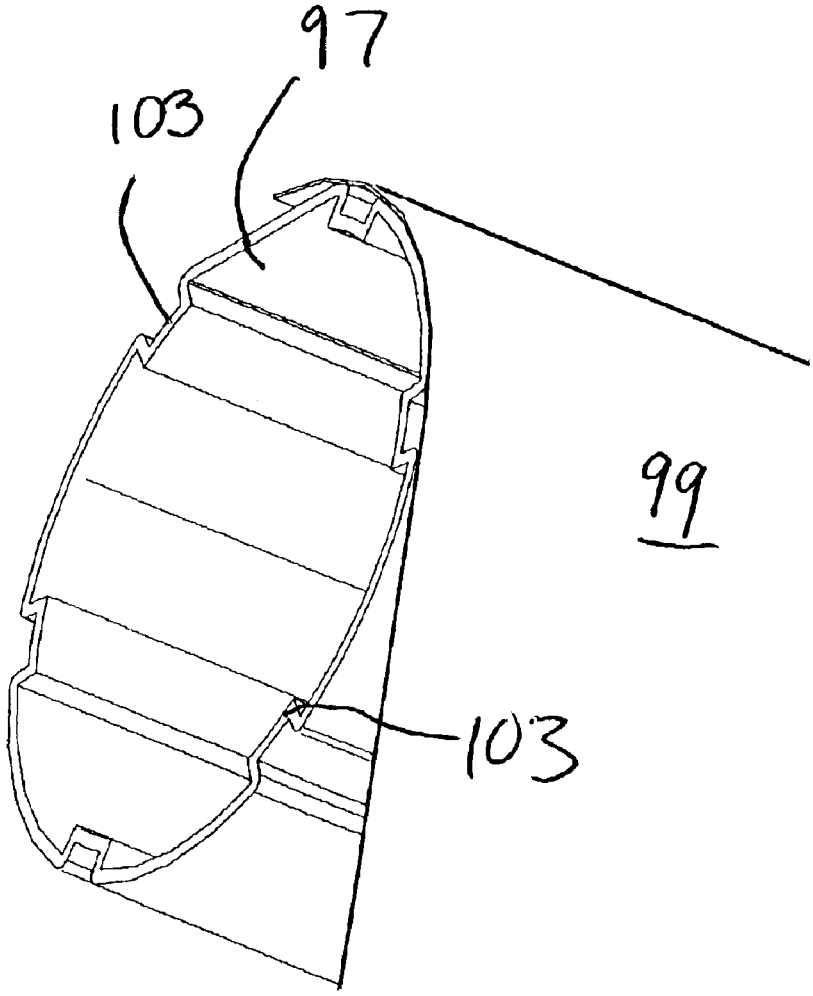
FIG. 17A is an enlarged detail of the end of the roller tube of FIG. 17.

As described previously, motorized shade rollers include drive motors for rotating the roller tube to wind and unwind a supported shade. Referring to FIG. 17, there is shown an exploded view of a motorized shade roller incorporating mounting assembly 50 of FIG. 8. The shade roller includes a roller tube 97 supporting a flexible shade 99. As shown in FIG. 17A, the wall of the roller tube 97 is formed to include longitudinal indentations 103 extending inwardly with respect to the interior of the roller tube. The indentations 103 are adapted for interfit with corresponding formations on the outer periphery of the bearings 70, 72 to facilitate engagement therebetween. The shade roller further includes a drive motor 101 that is receivable within the interior defined by roller tube 97 and engages roller 70 for rotating roller tube 97.

In the above discussion, the effect provided by modification of the boundary support conditions from the conventional end-supported roller tubes has focused on reducing the sagging deflection of long roller tubes. It should be understood, however, that application of the present invention is not limited to reduction of sagging deflection and could be used to provide for upward deflection of the central portion of the roller tube with respect to the opposite end portions.

As discussed above, the modified boundary support conditions provided by the present invention have application to shade systems having wide shades and correspondingly long roller tubes. The present invention provides for limitation or control of sagging deflections in long roller tubes without requiring increase in the diameter of the roller tubes. The present invention, however, is not limited in application to long roller tubes and has potential application for shorter roller tubes to provide for reduction of the diameter of such tubes without resulting sagging deflections that would otherwise occur were the reduced diameter roller tube to be supported in the conventional manner as a beam simply-supported at its opposite ends.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A system for mounting a shade roller including a roller tube having opposite ends, the mounting system comprising:

a pair of assemblies each including at least one bearing supported by an elongated bearing support member, the at least one bearing receivable within an interior defined by the roller tube and adapted for engagement therewith to define a support point for rotatably supporting the tube, the support point defining one end of an unsupported length of the roller tube that includes a central portion of the tube, the elongated bearing support member having opposite first and second ends, the bearing connected to the bearing support member adjacent the first end of the bearing support member, the bearing support member receivable within the tube interior to position the bearing at a distance from one of the opposite ends of the tube, the distance being sufficient to reduce the unsupported length of the roller tube such that sagging deflection is limited, each assembly further including an elongated attachment member having opposite first and second ends, the first end of the attachment member connected to the second end of the bearing support member such that the bearing support member extends adjacent at least a portion of the attachment member and substantially parallel thereto, the second end of the attachment member adapted for operably connecting the attachment member to a structure, the attachment member of each assembly including an end plate at the first end of the attachment member, the end plate being secured to an end of the bearing support member, the attachment member further including a top wall secured to the end plate and side walls secured to opposite sides of the top wall, the top and side walls extending substantially parallel to the bearing support member.

2. The mounting system according to claim 1, wherein each assembly further includes a shade mounting bracket secured to a wall of the structure and wherein the top wall of the attachment member of each assembly is secured to the shade mounting bracket adjacent the second end of the attachment member.

3. The mounting system according to claim 2, wherein each assembly further includes at least one threaded fastener received by the top wall of the attachment member and the shade mounting bracket to secure the attachment member directly to the shade mounting bracket.

4. The mounting system according to claim 2, wherein each assembly further includes a hinged member having a first portion secured to the top wall of the attachment member and a second portion secured to the shade mounting bracket for hingedly connecting the assembly to the structure.

5. The mounting system according to claim 4, wherein the length of the attachment member is substantially equal to the length of the bearing support member.

6. A system for rotatably supporting a roller tube having opposite ends, the system including a pair of mounting assemblies each comprising:

first and second bearings receivable within an interior defined by an end portion of the roller tube and adapted to engage the tube for rotatably supporting the tube;

an elongated bearing support member supporting the first and second bearings for engagement with the roller tube at spaced locations within the interior of the tube end portion, the bearing support member having opposite first and second ends; and a tube end support assembly secured to the bearing support member and attachable to a fixed support, the tube end support assembly adapted to pivot with respect to the fixed support in response, to tube loading such that a moment is applied to the roller tube end portion to limit sagging of the roller tube, the tube end support assembly including an end plate secured to the second end of the bearing support member and an elongated attachment member having opposite first and second ends, the first end of the attachment member connected to the end plate to extend longitudinally with respect to the roller tube, the tube end support assembly further including at least one mounting member for attaching the attachment member to the fixed support adjacent the second end of the attachment member, the at least one mounting member adapted to permit pivoting of the attachment member with respect to the fixed support, the tube end support assembly for each of the mounting assemblies further comprising a deflection adjustment mechanism including a separating member engaging the attachment member and adapted to contact a fixed support surface to establish a set pivoting of the attachment member.

7. The system according to claim 6, wherein the separating member is threadedly received by the attachment member adjacent the first end of the attachment member for adjusting the pivoting of the attachment member that is set by the separating member.

8. The system according to claim 6, wherein the tube end support assembly for each of the mounting assemblies further includes a bracket adapted for attachment to the fixed structure adjacent the first end of the attachment member to provide a bearing surface that is contacted by the separating member.

9. A mounting system for rotatably supporting a roller shade tube having opposite ends, the mounting system including a pair of assemblies each comprising:

first and second bearings receivable within an interior defined by the roller shade tube and adapted to engage the tube for rotatably supporting the tube;

an elongated bearing support member supporting the first and second bearings for engagement with the roller shade tube at spaced locations within the interior of the tube and adjacent an end portion, the bearing support member having opposite first and second ends; and an elongated attachment member having opposite first and second ends, the first end of the attachment member connected to the second end of the bearing support member such that the bearing support member extends adjacent at least a portion of the attachment member and substantially parallel thereto, the second end of the attachment member adapted for operably connecting the attachment member to a structure, the attachment member of each assembly including an end plate secured to the bearing support member at the first end of the attachment member, the attachment member further including a top wall and opposite side walls secured to the end plate such that the top and side walls extend substantially parallel to the bearing support member.

10. A system for rotatably supporting a roller tube having opposite ends, the system including a pair of mounting assemblies each comprising:

first and second bearings receivable within an interior defined by an end portion of the roller tube and adapted to engage the tube for rotatably supporting the tube;

an elongated bearing support member supporting the first and second bearings for engagement with the roller tube at spaced locations within the interior of the tube end portion, the bearing support member having opposite first and second ends; and a tube end support assembly secured to the bearing support member and attachable to a fixed support, the tube end support assembly adapted to pivot with respect to the fixed support in response to tube loading such that a moment is applied to the roller tube end portion to limit sagging of the roller tube, the tube end support assembly including an elongated attachment member having opposite first and second ends, the first end of the attachment member connected to the second end of the bearing support member, the engagement locations for the first and second bearings of each mounting assembly outwardly located along the roller tube with respect to the second end of the attachment member.

11. A system for rotatably supporting a roller tube having opposite ends, the system including a pair of mounting assemblies each comprising:

first and second bearings receivable within an interior defined by an end portion of the roller tube and adapted to engage the tube for rotatably supporting the tube;

an elongated bearing support member supporting the first and second bearings for engagement with the roller tube at spaced locations within the interior of the tube end portion, the bearing support member having opposite first and second ends; and a tube end support assembly secured to the bearing support member and attachable to a fixed support, the tube end support assembly adapted to pivot with respect to the fixed support in response to tube loading such that a moment is applied to the roller tube end portion to limit sagging of the roller tube, the tube end support assembly including an end plate secured to the second end of the bearing support member and an elongated attachment member having opposite first and second ends, the first end of the attachment member connected to the end plate to extend longitudinally with respect to the roller tube, the tube end support assembly further including at least one mounting member for attaching the attachment member to the fixed support adjacent the second end of the attachment member, the at least one mounting member adapted to permit pivoting of the attachment member with respect to the fixed support, the at least one mounting member including a bracket adapted for attachment to the fixed structure by at least one threaded fastener, the attachment member pivotably connected to the bracket adjacent the second end of the attachment member, the at least one mounting member further including a hinge member including a first plate secured to the bracket and a second plate secured to the attachment member adjacent the second end of the attachment member, the first and second plates the hinge member being pivotable with respect to each other.

12. A system for mounting an elongated roller tube having opposite ends and a length sufficiently large in comparison to its diameter such that the roller tube is subject to sag if not adequately supported, the mounting system comprising:

a pair of bearings each receivable interiorly of the roller tube at one of the opposite ends and engageable with the roller tube to provide a support point for the roller tube; and a pair of elongated bearing support members each supporting one of the bearings adjacent an end of the bearing support member, each of the bearing support members adapted to locate the associated bearing at a distance from one of the roller tube ends to define a central roller tube portion between the respective support points and a pair of roller tube end portions each extending outwardly from one of the support points in cantilever fashion, each cantilevered end portion of the roller tube having a length sufficiently large compared to a length of the central tube portion to provide a counterbalancing effect limiting sag in the central portion.

13. The system according to claim 12, wherein the length of each of the cantilevered end portions of the roller tube is equal to approximately 20 percent of the length of the roller tube.

14. A system for mounting a shade roller including a roller tube having opposite ends, the mounting system comprising:

at least one bearing receivable within an interior defined by an end portion of the roller tube and adapted for engagement therewith to define a support point for rotatably supporting the tube, the support point defining one end of an unsupported length of the roller tube that includes a central portion of the tube;

an elongated bearing support member having opposite first and second ends and receivable within the roller tube end portion, the at least one bearing connected to the bearing support member adjacent the first end of the bearing support member, the bearing support member receivable within the tube interior to position the bearing at a distance from each of the opposite ends of the tube such that the unsupported length of the roller tube is reduced to limit sagging deflection of the roller tube to about ten percent or less of what the sagging deflection of the roller tube would have been if substantially the entire length of the roller tube was unsupported;

an end plate secured to the second end of the bearing support member and an elongated attachment member having opposite first and second ends, the first end of the attachment member connected to the end plate to extend longitudinally with respect to the roller tube and adapted for attachment to a fixed support member, the attachment member secured to a shade mounting bracket adjacent the second end of the attachment member, the shade mounting bracket adapted for attachment to a fixed surface; and a hinge member including a first plate secured to the shade mounting bracket and a second plate secured to the attachment member adjacent the second end of the attachment member, the first and second plates of the hinge member being pivotable with respect to each other.

* * * * *

UNITED STATES PATENT AND TRADEMARK OFFICE

CERTIFICATE OF CORRECTION

PATENT NO. : 6,902,141 B2
APPLICATION NO. : 10/338066
DATED : June 7, 2005
INVENTOR(S) : David A. Kirby It is certified that error appears in the above-identified patent and that said Letters Patent is hereby corrected as shown below:

Title page item 57

In the Abstract, line 7, after “moment”, insert --to--.

Col. 6, line 57, change “FIG. 11” to --FIG. 11,--.

Col. 6, line 60, change “$M_R$” to --M--.

Col. 6, line 63, after “roller tube”, change “53” to --55--.

Col. 6, line 64, after “application of the moments”, insert --M--.

Col. 6, line 64, after “to the opposite”, change “the moments $M_R$” to --end portions--.

Col. 7, line 12, change “FIG. 14” to --FIG. 14,--.

Col. 9, line 58, change “support in response,” to --support in response--.

Col. 11, line 47, after “second plates” and before “the hinge member”, insert --of--.

Signed and Sealed this

Eighth Day of January, 2008

JON W. DUDAS
*Director of the United States Patent and Trademark Office*